US007621376B2

(12) United States Patent
Duenser et al.

(10) Patent No.: US 7,621,376 B2
(45) Date of Patent: Nov. 24, 2009

(54) ELEVATOR INSTALLATION AND METHOD FOR OPERATING A VERTICAL ELEVATOR SHAFTS ARRANGED ADJACENT TO ONE ANOTHER

(75) Inventors: Thomas Duenser, Rikon (CH); Philipp Angst, Zug (CH)

(73) Assignee: Inventio AG, Hergiswil NW (CH)

( * ) Notice: Subject to any disclaimer, the term of this patent is extended or adjusted under 35 U.S.C. 154(b) by 579 days.

(21) Appl. No.: 11/179,120

(22) Filed: Jul. 12, 2005

(65) Prior Publication Data

US 2006/0011420 A1 Jan. 19, 2006

(30) Foreign Application Priority Data

Jul. 15, 2004 (EP) ..... 04405453

(51) Int. Cl.
*B66B 1/20* (2006.01)
*B66B 9/00* (2006.01)

(52) U.S. Cl. ..... 187/249; 187/247; 187/382

(58) Field of Classification Search ..... 187/380–382, 187/388, 902, 247, 249
See application file for complete search history.

(56) References Cited

U.S. PATENT DOCUMENTS

| | | | | | |
|---|---|---|---|---|---|
| RE18,095 | E | * | 6/1931 | Sprague | 187/249 |
| 1,837,643 | A | * | 12/1931 | Anderson | 187/249 |
| 1,976,495 | A | * | 10/1934 | Halfvarson | 187/249 |
| 3,658,155 | A | | 4/1972 | Salter | |
| 4,946,006 | A | | 8/1990 | Kume | |
| 5,419,414 | A | * | 5/1995 | Sakita | 187/391 |
| 5,660,249 | A | * | 8/1997 | Powell et al. | 187/249 |
| 5,865,274 | A | * | 2/1999 | Kiji et al. | 187/380 |
| 5,877,462 | A | * | 3/1999 | Chenais | 187/249 |
| 5,924,524 | A | * | 7/1999 | Barker et al. | 187/249 |
| 6,273,217 | B1 | * | 8/2001 | Hikita | 187/388 |
| 6,360,849 | B1 | * | 3/2002 | Hikita | 187/381 |
| 6,364,065 | B1 | * | 4/2002 | Hikita | 187/382 |
| 6,955,245 | B2 | * | 10/2005 | Dunser et al. | 187/382 |
| 7,032,716 | B2 | * | 4/2006 | Meyle et al. | 187/382 |
| 7,357,226 | B2 | * | 4/2008 | Sakita | 187/249 |
| 7,377,365 | B2 | * | 5/2008 | Abe et al. | 187/396 |
| 2004/0089504 | A1 | * | 5/2004 | Kostka | 187/393 |
| 2006/0163008 | A1 | * | 7/2006 | Godwin | 187/288 |

FOREIGN PATENT DOCUMENTS

| | | |
|---|---|---|
| EP | 0 769 469 | 4/1997 |
| EP | 1 367 018 | 12/2003 |

* cited by examiner

*Primary Examiner*—Walter Benson
*Assistant Examiner*—Eduardo Colon-Santana
(74) *Attorney, Agent, or Firm*—Fraser Clemens Martin & Miller LLC; William J. Clemens

(57) ABSTRACT

An elevator installation has at least three vertical elevator shafts arranged adjacent to one another, at least one boarding zone and a plurality of individually movable elevator cars. At least two directly adjacent changeover zones are provided in the region of the boarding zone and enable horizontal displacement of the elevator cars between the elevator shafts.

12 Claims, 6 Drawing Sheets

ELEVATOR INSTALLATION AND METHOD FOR OPERATING A VERTICAL ELEVATOR SHAFTS ARRANGED ADJACENT TO ONE ANOTHER

BACKGROUND OF THE INVENTION

The present invention relates to elevator installations with vertical elevator shafts arranged adjacent to one another and individually movable elevator cars able to carry out a shaft change, as well as to a method of operating such elevator installations.

Every elevator installation requires a certain proportion of space in a building depending on the traffic volume. The larger the traffic volume and the higher the building, the more space the elevator installation needs in relation to usable area (net useful area) of the building. The performance of an elevator installation can be expressed by the so-called handling capacity. The handling capacity indicates how many persons can be transported per minute in the case of high traffic volume, for example at the beginning of a working day in an office building.

It is therefore of concern to minimize the space requirement of an elevator installation. This is achieved by measures which allow reduction in the handling capacity per area unit or volume unit of the space needed for the elevator installation.

One route to increasing handling capacity without demanding an excessive amount of space consists in enabling several elevator cars to run simultaneously in an elevator shaft or in providing, in accordance with the paternoster principle, an upward elevator shaft and a downward elevator shaft in which several elevator cars move in fixed relationship at a common, encircling support means. In such elevator installations it is possible to achieve, by suitable measures, an optimally short time between departure of a first elevator car and arrival of a further elevator car.

An elevator system 10 operating according to the paternoster principle is schematically shown in FIG. 1 in a sectional illustration, wherein in this elevator system 10 the elevator cars move, in departure from the paternoster elevator, individually. Two vertical elevator shafts 11.1 and 11.2 are provided, in which several elevator cars 16, which are driven individually or in common, move. Changeover points are provided at the upper and lower shaft ends so as to enable horizontal displacement of the elevator cars 16. The elevator cars 16 travel upwardly on the left and downwardly on the right. The individual floors are characterized by the reference numerals 13.1-13.5. Displacement from one shaft to another shaft requires time, which limits the handling capacity of the elevator system 10.

There are various approaches for arrangement of parallel elevator shafts of an elevator installation, for changing over of elevator cars from one elevator shaft to another elevator shaft (shaft change) and for providing and operating more than only one elevator car in an elevator shaft.

A possible arrangement with two elevator shafts and a changeover zone is described in U.S. Pat. No. 3,658,155. The elevator cars move individually along rail equipment.

It is a disadvantage of the known elevators with several elevator shafts that displacement of an elevator car to another shaft is very complicated in mechanical terms and frequently takes place only slowly. A limit is thus imposed on handling capacity in the case of increased traffic volume. It has proved that the time between departure of a first elevator car and arrival of a further elevator car is substantially dependent on the time used for displacing (shaft change) an elevator car in the elevator shaft.

An arrangement which comprises four elevator shafts with connecting passages at the upper end and lower end is known from the European patent application with the title "Sicherheitseinrichtung bei Multimobil-Aufzugsgruppen", which was published under the number EP 769469-A1. The advantages or disadvantages of such multi-mobile elevator groups with respect to handling capacity are not dealt with in the cited application.

An elevator installation with elevator cars having an autonomous linear drive which is disposed at the car and makes it possible for the elevator cars to independently move in the elevator shafts in a vertical direction is known from the European patent application published under the number EP 1367018-A2. The elevator cars are constructed in such a manner that it is possible to also reliably manage a transverse displacement.

The handling capacity of such an elevator installation can be increased, as was sought at different times, in that the changeover mechanism, which is decisive for the shaft change, is improved. However, the mechanical outlay for achieving a more rapid shaft change is comparatively large.

SUMMARY OF THE INVENTION

In consideration of the known arrangements, it is an object of the present invention to provide an elevator installation and a corresponding method which reduce or entirely avoid the disadvantages of the state of the art.

It is a particular object of the invention to provide an elevator installation and a corresponding method in which the handling capacity in relation to an area unit or space unit of a building is reduced by comparison with known approaches.

The present invention is based upon the fact that the procedures which are relatively time-consuming per se, namely loading and unloading of the elevator cars on the one hand and the shaft change of the elevator cars on the other hand, are decoupled from one another as far as possible in terms of space and time. This takes place by maintenance of specific criteria in the design and realization of an elevator installation and by a suitable elevator control of the various procedures taking place in such an elevator installation.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
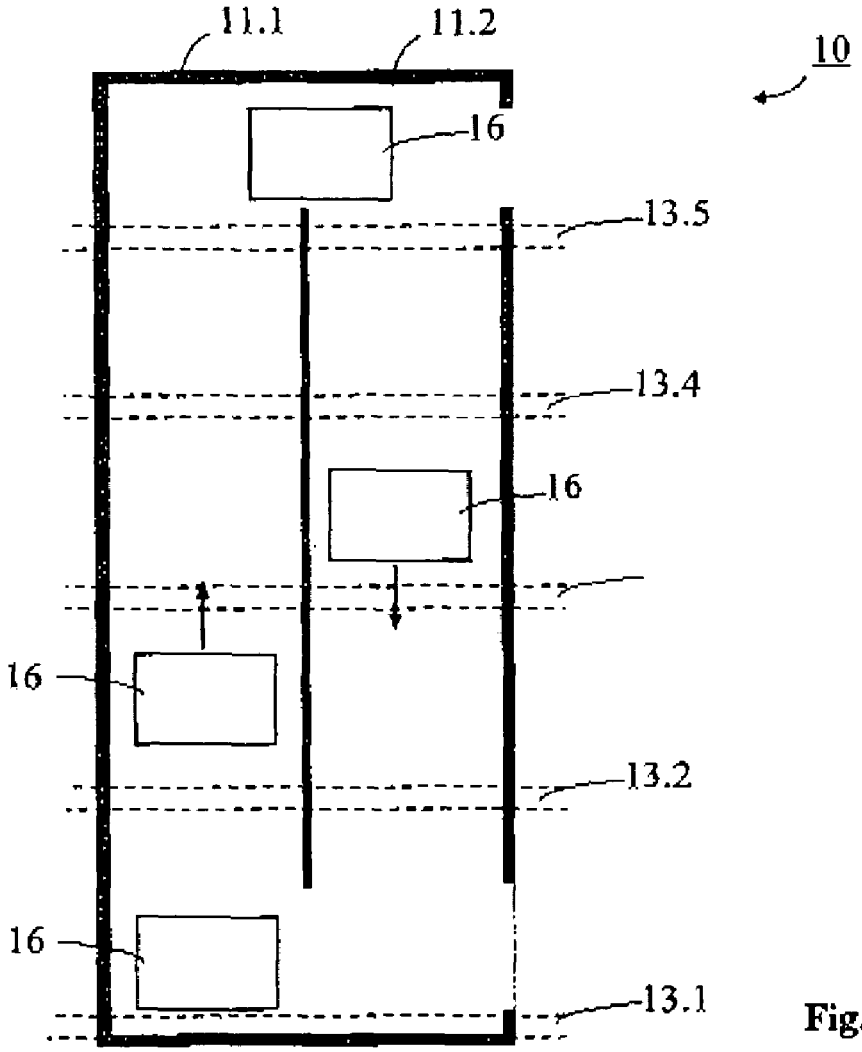
Fig. 1 (PRIOR ART)
FIG. 1 is a schematic, side sectional view of a known elevator installation.

A first embodiment of the present invention is described in connection with FIG. 2. An elevator installation 20 is shown in a schematic sectional illustration from one side. The elevator installation 20 comprises n=3 vertical elevator shafts 11.1, 11.2 and 11.3 arranged adjacent to one another. The vertical elevator shafts 11.1, 11.2 and 11.3 can, but do not have to be, physically separated from one another. In total, five floors 13.1-13.5 are served. Several individually movable elevator cars 16.1-16.9 are disposed within the elevator shafts 11.1, 11.2 and 11.3. At least two changeover zones 12.1 and 12.2 directly adjacent to one another are provided in the region of a boarding zone 17.1, which enables displacement of the elevator cars 16.1-16.9 between the elevator shafts 11.1, 11.2 and 11.3. In the present example the two changeover zones 12.1, 12.2 lie one directly above the other. The lowermost floor, which is denoted in FIG. 2 by 13.1, is regarded as the boarding zone 17.1 in the present example. The boarding zone can also be introduced, for example, in the region of a main stop, a main access or an entrance lobby (main lobby). Doors, which are denoted by 14, are present on each floor in the illustrated example. In the depicted snapshot, two elevator cars 16.5 and 16.6 are just disposed in the region of the boarding zone 17.1 and the corresponding doors 14.1, 14.2 are opened. For the sake of simplicity, the open doors are illustrated in black.

The elevator installation 20 can be operated as follows: In the case of need, for example after a request call has taken place, or automatically, the elevator cars 16.5, 16.6 are provided in at least the two elevator shafts 11.1 and 11.2 in the region of the boarding zone 17.1 for direct loading/unloading and transporting. Further elevator cars 16.7, 16.8, 16.9 are kept available in the region of the changeover zones 12.1, 12.2. These elevator cars are moved up on each occasion when one of the elevator cars has left the boarding zone 17.1. In the illustrated example, the elevator car 16.4 has begun upward travel and the elevator car 16.7 is moved up from the changeover zone 12.1. The changeover zones 12.1, 12.2 are designed so that the elevator cars can be horizontally displaced individually or in common.

Figure 2:
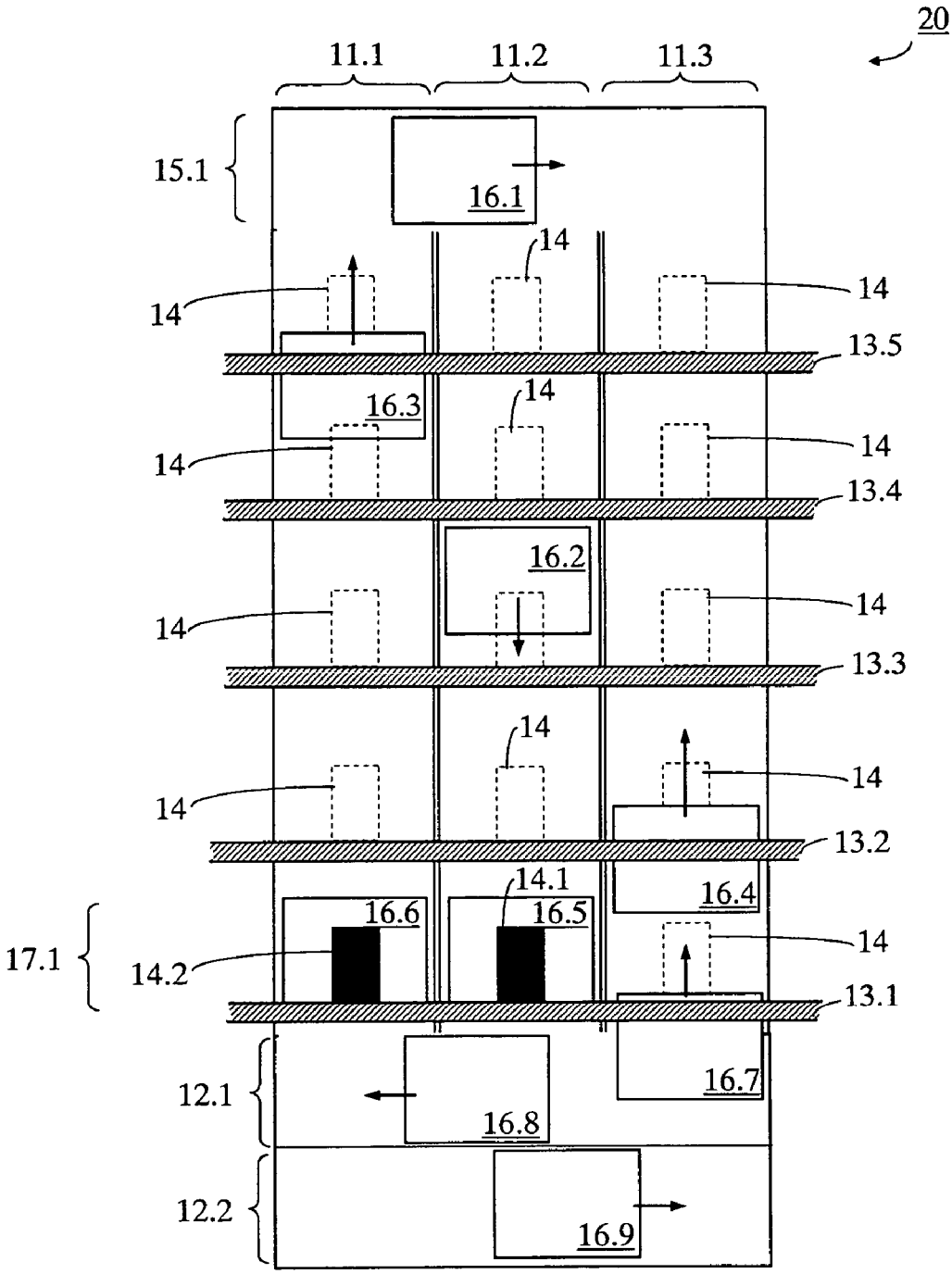
FIG. 2 is a schematic, side sectional view of a first embodiment elevator installation according to the present invention.

At least one further changeover zone 15.1 can be provided in the upper region of the elevator shafts 11.1-11.3, as shown in FIG. 2.

It is an advantage of the illustrated arrangement that an empty elevator car can be provided in the region of the boarding zone 17.1 at any time for each of the n=3 elevator shafts. Thus, the time required for a shaft change of an elevator car has only a subordinate role. Only when, in the illustrated form of embodiment, several upward journeys take place in succession in two or three elevator shafts is the capacity of the two changeover zones 12.1, 12.2 no longer sufficient to provide empty elevator cars at the right time.

Some of the terms employed are stated more precisely in the following before dealing with further forms of embodiment of the invention.

As the elevator shaft there is denoted a region which is designed for vertical upward and/or downward movement of elevator cars. However, it is to be taken into consideration in the explanation of the term "elevator shaft" that in the case of some elevator installations a shaft in the actual sense is no longer provided. There are, for example, arrangements in which the elevators are open towards several sides and the elevator cars move along guide rails. The present invention can also be applied to such elevator arrangements. As already mentioned, a physical separation between the individual elevator shafts of an elevator installation is also not necessary.

According to the present invention, the elevator cars are individually movable. The individual mobility can be realized in different mode and manner and several examples for elevator installations of that kind are known from the state of the art and can be used in conjunction with the present invention. However, there is a precondition which has to be fulfilled in connection with the present invention. The elevator cars have to be constructed so that in addition to the vertical mobility they can also be displaced horizontally between the elevator shafts or can automatically execute a horizontal displacement. There are also some examples with respect thereto from the state of the art, which will be discussed only to such an extent as is essential to the present invention.

A boarding plane or several boarding planes is or are termed boarding zone. Typically, the ground floor is regarded as boarding zone, since here, according to the respective layout of the overall building, a particularly large traveling volume prevails. The boarding zone can also be introduced in the region of, for example, a main stop, a main access or an entrance hall (main lobby). There are buildings which have a boarding zone with two or more floors, often also half floors. It is conceivable, for example, that an escalator leads from the ground floor to a first floor and there to one of the elevator shafts and an escalator in a first basement floor leads to a further one of the elevator shafts. The corresponding floors are together termed boarding zone in the sense of the present invention. A boarding zone can also be arranged in another region of an elevator installation, for example in the upper shaft region. There can also be several boarding zones in an elevator installation.

The terms boarding zone and boarding plane are also applied synonymously to disembarkation zones and disembarkation planes, respectively. The term loading shall obviously also include unloading.

According to the present invention, the travel direction in the individual elevator shafts does not have to be fixed. Through a traffic-dependent elevator control an elevator installation with n=5 elevator shafts can have, for example, three upward shafts and two downward shafts in the morning. Towards the evening more downward shafts than upward shafts can then be provided. However, the invention can also be used on elevator installations which have a fixed allocation of upward and downward shafts, as long as $n \geqq 3$ elevator shafts are present.

The present invention is substantially independent of the position and arrangement of the boarding openings or doors. The doors can, in FIGS. 2, 3, 4 and 5B, lie in the plane of the drawing or in another plane perpendicular to the plane of the drawing.

Figure 3:
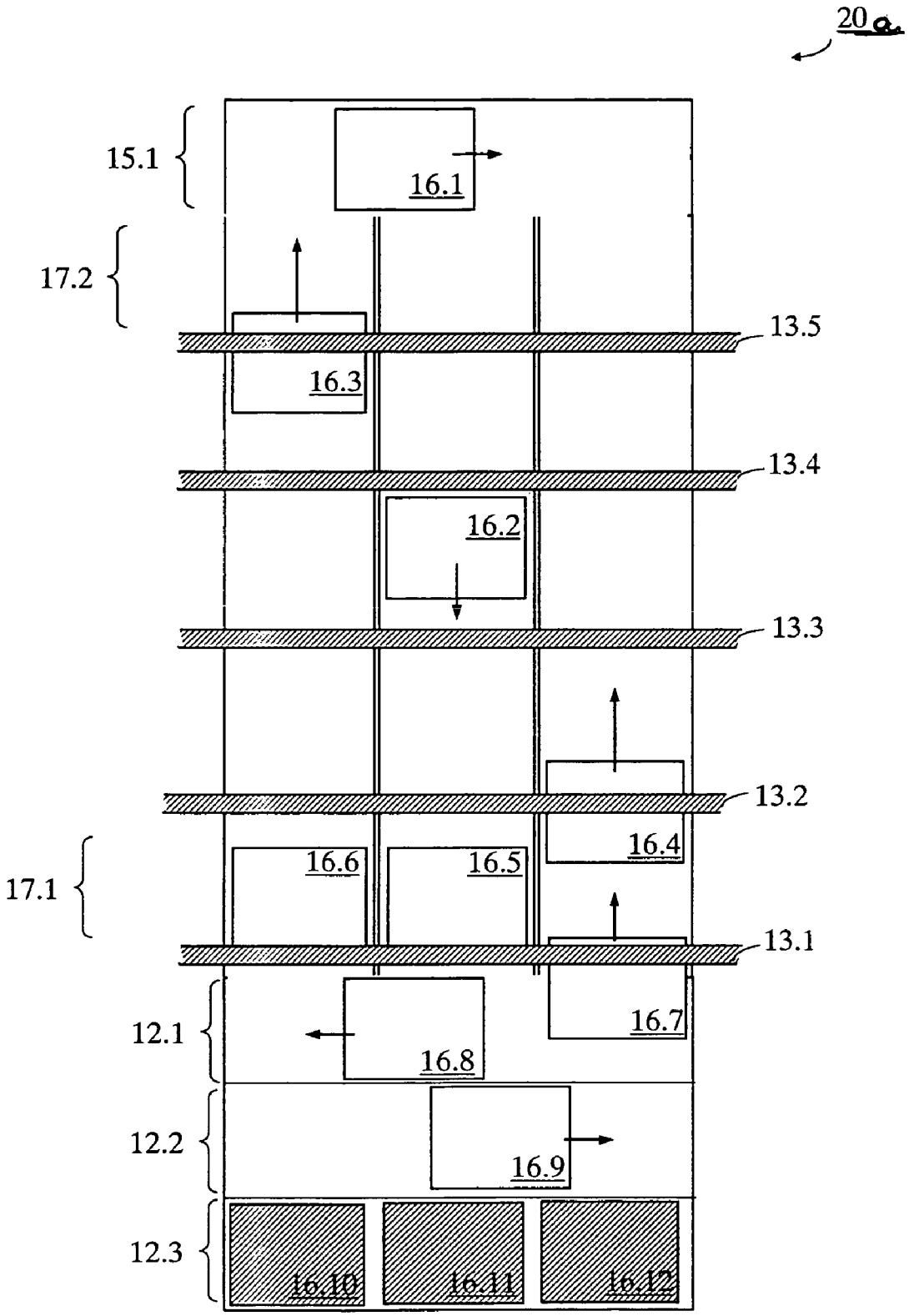
FIG. 3 is a schematic, side sectional view of a second embodiment elevator installation according to the present invention.

Investigations have shown that the more changeover zones are necessary, the more slowly the shaft change of individual elevator cars takes place. It is therefore conceivable that an elevator installation according to the present invention with n=3 elevator shafts has more than only two adjacent changeover zones in the region of one of the boarding zones. An example of such an elevator installation 20*a* is illustrated in FIG. 3, wherein here only the fundamental elements are shown. The illustrated elevator installation 20*a* has n=3 elevator shafts 11.1, 11.2 and 11.3. Again, five floors 13.1-13.5 are served, wherein the principle of the present invention is transposable to buildings with a greater or lesser number of floors. Several individually movable elevator cars 16.1-16.9, which are currently disposed in use (in motion), are located within the elevator shafts 11.1, 11.2 and 11.3. Three changeover zones 12.1, 12.2 and 12.3 which are directly adjacent to one another, i.e. lying one above the other, are provided in the region of the lower boarding zone 17.1, which enables displacement of the elevator cars 16.1-16.12 between the elevator shafts 11.1, 11.2 and 11.3 and depositing of elevator cars. In the illustrated example, three elevator cars 16.10, 16.11 and 16.12 are parked. Since these elevator cars 16.10, 16.11 and 16.12 are not at the moment disposed in circulation, they are illustrated with hatching. In the case of need, one or more of the elevator cars 16.10, 16.11 and 16.12 can be removed from the changeover zone 12.3 and readied.

The lowermost floor 13.1 and the uppermost floor 13.5 are regarded as boarding zones 17.1, 17.2 in the present example of embodiment. In the illustrated example, doors, which are not, however, shown in FIG. 3, are present at different floors. Two elevator cars 16.5 and 16.6 are located just in the region of the boarding zone 17.1. The left-hand shaft 11.1 and the right-hand shaft 11.3 are, at the illustrated instant, operated as upward shafts and the middle shaft 11.2 serves as a downward shaft.

Figure 4:
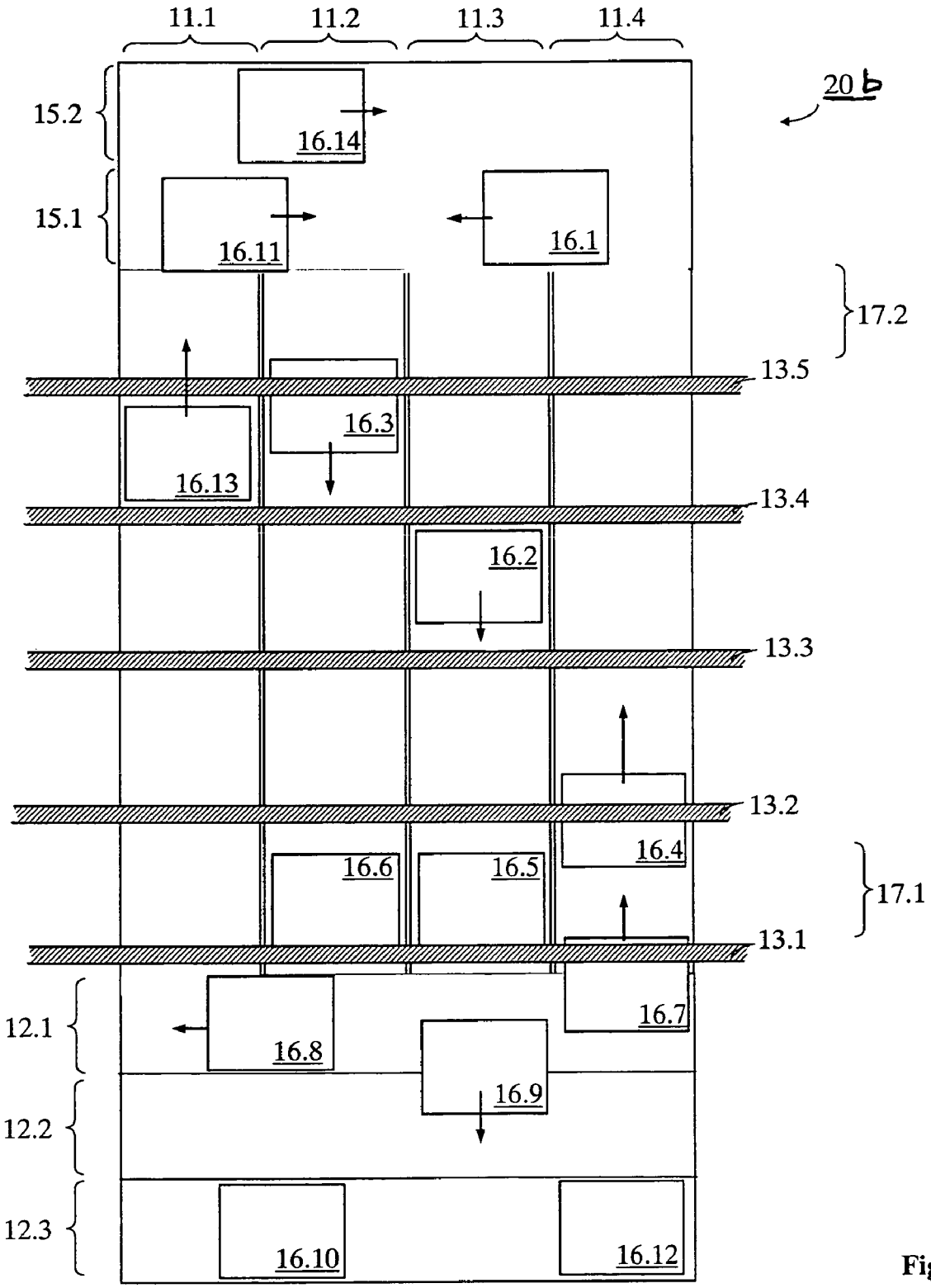
FIG. 4 is a schematic, side sectional view of a third embodiment elevator installation according to the present invention.

An example of a further elevator installation **20*b* is illustrated in FIG. 4, wherein here, too, only the basic elements are shown. The illustrated elevator installation 20*b* comprises n=4 elevator shafts 11.1, 11.2, 11.3 and 11.4. Five floors 13.1-13.5 are again served. Several individually movable elevator cars 16.1-16.14, which are currently disposed in use, are located within the elevator shafts 11.1-11.4. Three changeover zones 12.1, 12.2 and 12.3 disposed one above the other are provided in the region of the lower boarding zone 17.1 and enable displacement of the elevator cars 16.1-16.14 among the elevator shafts 11.1-11.4. In the illustrated example, the elevator car 16.8 is just changing in the changeover zone 12.1 from the elevator shaft 11.2 to the elevator shaft 11.1. Since the elevator car 16.7 is just moving up in the elevator shaft 11.4, the elevator car 16.9 cannot carry out the shaft change in the region of the changeover zone 12.1**, but has to be moved downwardly to a lower changeover zone, as indicated by a downward arrow.

Figure 5A:
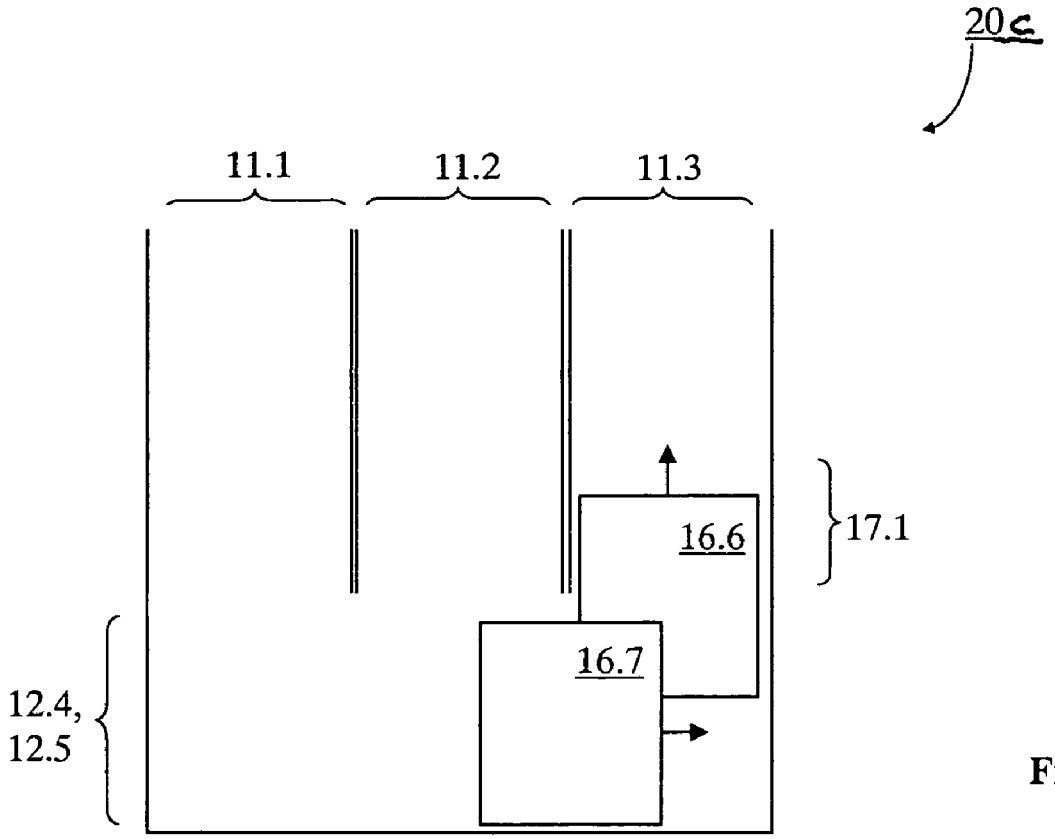
FIG. 5A is a schematic, side sectional view of a fourth embodiment elevator installation according to the present invention.
Figure 5B:
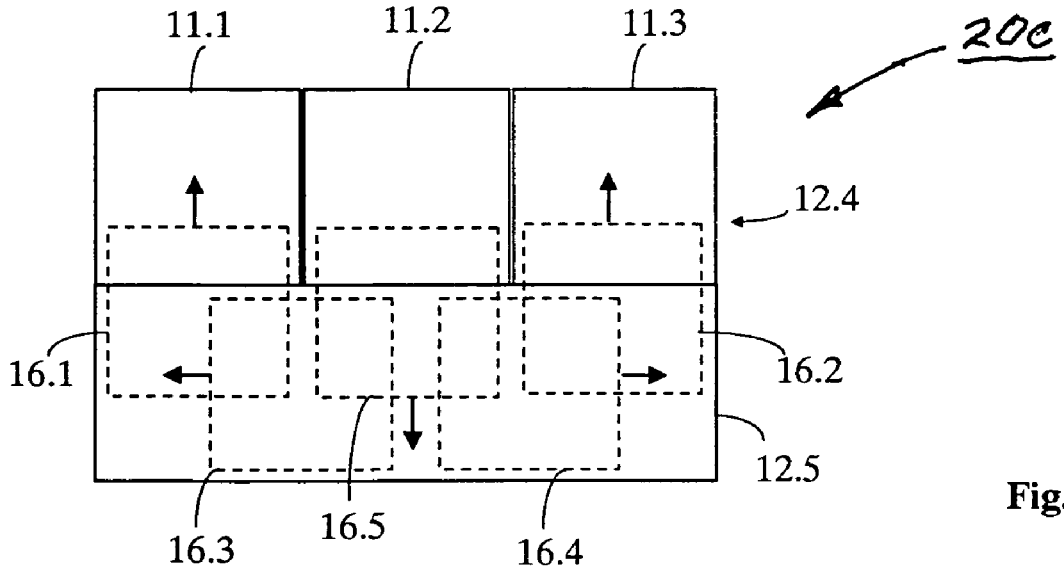
FIG. 5B is a schematic plan view of the fourth elevator installation shown in FIG. 5A.

A further form of embodiment is shown in FIGS. 5A and 5B. FIG. 5A is a schematic side view of the lower region of an elevator installation **20*c* with n=3 elevator shafts 11.1-11.3. FIG. 5B is a plan view of the elevator installation 20*c*. The changeover zones can, as illustrated in these two figures, lie on one and the same plane (floor). In the illustrated case a first changeover zone 12.4 is positioned directly below the n=3 elevator shafts 11.1-11.3 and a further changeover zone 12.5** extends parallel to the first changeover zone (parallel to the "X" axis).

Different possible positions of the individual elevator cars are indicated in FIG. 5B. The elevator car 16.1 moves, for example, horizontally from the changeover zone 12.5 to the changeover zone 12.4. This shaft change is carried out in a space disposed below the left-hand elevator shaft 11.1. The elevator car 16.2, for example, moves horizontally from the changeover zone 12.5 to the changeover zone 12.4. However, this shaft change is carried out below the right-hand elevator shaft 11.3. The elevator car 16.5 moves horizontally from the changeover zone 12.4 to the changeover zone 12.5. This shaft change is carried out below the middle shaft 11.2. The two elevator cars 16.3 and 16.4 move horizontally in the changeover zone 12.5 to the left or to the right.

FIG. 5A is a schematic side view of a lower region of the elevator installation **20*c*. In FIG. 5A there is shown a situation in which the elevator car 16.6 is disposed in the vertical transition in the right-hand shaft 11.3, but the boarding zone 17.1 has still not been reached. A further elevator car 16.7 already moves up horizontally in the changeover zone 12.5, wherein this changeover zone 12.5 is disposed in front of the changeover zone 12.4. The two elevator cars 16.6 and 16.7 thereby do not collide. In the case of the embodiment according to FIGS. 5A and 5B, the elevator cars can be horizontally displaced not only in the changeover zone 12.4, but also in the changeover zone 12.5. However, a transition to the elevator shafts 11.1, 11.2, 11.3 is possible only from the changeover zone 12.4**.

Figure 6:
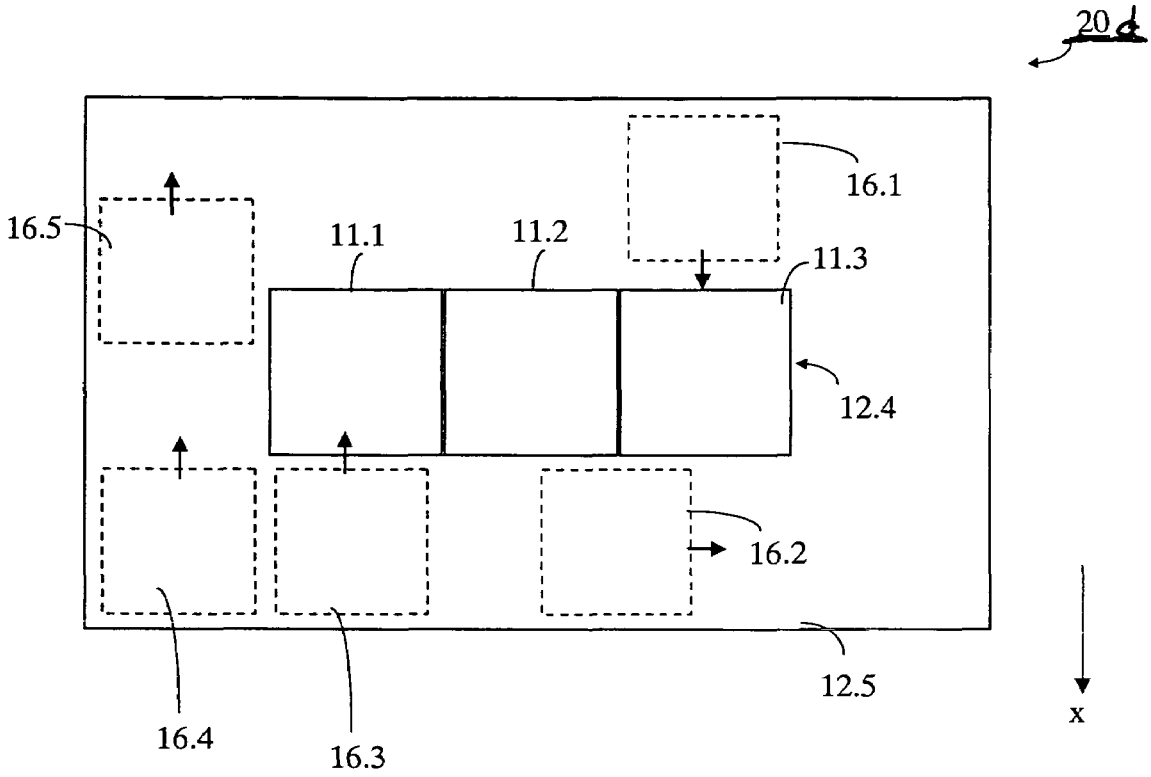
FIG. 6 is a schematic plan view of a fifth embodiment elevator installation according to the present invention.

A further embodiment of the present invention is shown in FIG. 6. An elevator installation **20*d* is shown in schematic plan view. Here, too, n=3 elevator shafts 11.1-11.3 are provided. Disposed directly below the n=3 elevator shafts 11.1-11.3 is a changeover zone 12.4 having, in the plane of the drawing, an extent of area approximately corresponding with the extent area of the n=3 elevator shafts 11.1-11.3. A further changeover zone 12.5 surrounds the changeover zone 12.4. Elevator cars can now carry out a shaft change in the changeover zone 12.4 directly below the elevator shafts 11.1-11.3. Thus, for example, an elevator car can leave the elevator shaft 11.2 downwardly and be displaced horizontally to the right in the changeover zone 12.4. As soon as the elevator car has arrived below the elevator shaft 11.3, it can be moved vertically into the elevator shaft 11.3. Other elevator cars are in turn displaced in the region of the changeover zone 12.5, as shown on the basis of a single example. The elevator car 16.1 moves horizontally from the changeover zone 12.5 to the changeover zone 12.4 and, in particular, so that it can then be directly taken over from the changeover zone 12.4 to the elevator shaft 11.3. The elevator car 16.2 moves horizontally to the right in the changeover zone 12.5. The elevator car 16.3 moves horizontally from the changeover zone 12.5 to the changeover zone 12.4 and, in particular, so that it can then be directly taken over from the changeover zone 12.5 to the elevator shaft 11.1. The elevator cars 16.4 and 16.5 move within the changeover zone 12.5** horizontally in a negative "X" direction.

In the embodiment shown in FIG. 6, the changeover zone 12.5 serves as a form of circulation zone which enables a very flexible displacement and readying of the individual elevator cars.

Depending on the respective forms of embodiment of the present invention a further increase in handling capacity with respect to the space occupied by the elevator installation is achieved in that one or several of the following measures are linked together in the planning or execution:

- use of (special) elevator shafts 11.1-11.4 for rapid travel (long-distance travel without stopping over several floors);
- use of (special) elevator shafts 11.1-11.4 with a reduced number of boarding zones;
- dividing up the elevator shafts 11.1-11.4 so that, for a shaft change, as far as possible only a single change step is necessary, which is advantageous since the duration of the shaft change depends on the number of change steps. The elevator installation **20*b* shown in FIG. 4 is distinguished, for example, by the fact that the two downward shafts 11.2, 11.3 are arranged in the middle between two upward shafts 11.1, 11.4. The elevator car 16.8, for example, after removal from the downward shaft 11.2 only has to execute one change step in order to be able to be provided again in the upward shaft 11.1**. This division criterion is also for simplification termed symmetry criterion. With respect to the symmetry criterion, account can also be taken, for example, that the elevator shafts are arranged not only adjacent to one another, but also behind one another.

One of the changeover zones can be designed as a depot zone (see, for example, FIG. 3), in which a certain number of elevator cars can be so kept in readiness for use that in the case of need they can be moved relatively quickly, i.e. as far as possible without prior transverse movement, into a boarding zone 17.1. The depot zone also offers the possibility of undertaking maintenance or repair operations at the elevator cars.

The changeover zones can also lie in one and the same plane. In this case, however, the changeover zones extend in depth in the building (see, for example, FIGS. 5A, 5B and 6).

The changeover zones can be equipped with different changeover mechanisms, wherein preferably one of the changeover zones enables a more rapid shaft change (rapid changeover zone) than the other, slower changeover zone. The slower changeover zone then has, however, preferably a greater receiving capacity than the rapid changeover zone.

A special readying sequence can be provided in order to be able to provide elevator cars at the different positions in the elevator installation 20 (20*a*-20*d*) in accordance with a default setting, wherein this readying sequence is preferably carried out when no or only a small transport need exists. It can thereby be ensured that the elevator installation 20 (20*a*-20*d*) is disposed in a defined initial state before an increased transport need occurs.

In a particularly preferred form of embodiment, the elevator installation is designed in accordance with the following formula: m=n−1, wherein "n" is a whole number greater than three and "m" defines the number of changeover zones. This formula is applicable primarily up to n=5 elevator shafts.

In further preferred forms of embodiment one or more of the changeover zones are so designed that they have an access opening, which can be used as a depot zone (for example 12.3 in FIG. 3), and/or are usable as a service region. This presupposes that this changeover zone is not frequented very much or that the elevator control of the elevator installation is so designed that in the service case, or if such an access opening is used, the different sequences in the elevator installation are adapted. Such an access opening can serve as, for example, access to a heating basement or other rooms which are frequented less often. They can also serve as access to a roof plane if they are disposed at the upper end of the elevator installation 20 (20*a*-20*d*).

The previous embodiments, which were made primarily in connection with upward traffic, are also analogously applicable to downward traffic. If, for example, an observation platform is located in the building then the boarding zone 17.2 in the upper building region can also be a bottleneck which can be "relieved" by provision of two or more adjacent changeover zones.

The elevator installation comprises an elevator control which is preferably so designed that provision of empty elevator cars takes place in dependence on need. For this purpose empty elevator cars are deposited in the changeover zones 12.1-12.4, 15.1, 15.2 in waiting positions near the boarding zones 17.1, 17.2 in order to make possible rapid provision in the case of a request call. The need-dependent provision of elevator cars can also take place at different floors.

In a preferred embodiment each of the elevator cars 16.1-16.14 has an autonomous linear drive which is at the car and enables automatic movement of the elevator cars 16.1-16.14 in the vertical direction in the elevator shafts 11.1-11.4. A system of that kind is sufficiently known and can be inferred from, for example, the European patent application which was published under the number EP 1367018-A2. According to such an embodiment of the present invention a drive part which does not conduct current (for example the secondary part of a linear motor drive) and along which the linear drive moves is arranged at a rearward shaft wall. The linear drive comprises a drive control which makes it possible to so control the linear drive that this produces an upward travel or downward travel of the corresponding elevator car 16.1-16.14 in the respective elevator shaft 11.1-11.4.

In addition, the elevator cars 16.1-16.14 in a further embodiment comprise a drive so as to be able to displace the elevator cars 16.1-16.14 independently in the horizontal direction from an elevator shaft 11.1-11.4 into a changeover zone 12.1-12.4, 15.1, 15.2 or out of a changeover zone 12.1-12.4, 15.1, 15.2. Moreover, this drive is designed so that a horizontal displacement is possible within the changeover zones 12.1-12.2, 15.1, 15.2.

In another embodiment, the elevator cars 16.1-16.14 are, in fact, equipped so that they can vertically move individually and almost autonomously in the elevator shafts, but on entry into the changeover zones 12.1-12.4, 15.1, 15.2 they are taken over by a stationary changeover mechanism (for example in the form of a displacing device or (conveying) means) which manage the change. On leaving the changeover zones 12.1-12.4, 15.1, 15.2 the elevator cars 16.1-16.14 then change back into a mode which allows an individual and almost autonomous vertical movement.

Alternatively, the linear drive which is present and is used for vertical movement of the elevator cars 16.1-16.14 can be so turned over that this linear drive is also usable for producing the horizontal displacement between adjacent elevator shafts 11.1-11.4 in the region of the changeover zones. A technical realization, by way of example, can be inferred from the cited publication EP 1367018 A2.

Instead of with an autonomous linear drive at the car, the elevator cars 16.1-16.14 can also be provided with a friction wheel drive, gearwheel drive, rack drive or the like.

According to a further embodiment of the present invention the elevator system 20 (20*a*-20*d*) comprises an elevator control. The elevator control is so designed that a so-called need profile is incorporated so as to enable provision of empty elevator cars 16.1-16.14 depending on need. Such a need profile can be fixedly predetermined or can adapt dynamically. Preferably the need profile is stored in a memory. Particularly suitable is a need profile in which certain basic need patterns are predetermined, but which automatically further develop through observation of the daily elevator operation. Preferably the elevator control has routine sequences which establish provision and movement of the elevator cars 16.1-16.14 in the changeover zones 12.1-12.4, 15.1, 15.2 on the basis of specific rules.

It is obvious that there are different variants of the elevator control which can be transplanted to an elevator installation according to the present invention with two and more adjacent changeover zones. Preferably the elevator control has a certain degree of authority over control units of the individual elevator cars 16.1-16.14. This is of advantage for the following reasons:

- avoidance of collisions of the elevator cars 16.1-16.14;
- provision of the elevator cars 16.1-16.14 in the elevator shafts and/or changeover zones depending on need;
- provision of the elevator cars in a depot region of a changeover zone depending on need;
- reversal of direction in the elevator shafts 11.1-11.4;
- special traffic in the case of maintenance or in the case of other disturbances, etc.

According to a further preferred embodiment of the present invention, the elevator installation is so designed that before carrying out a change of an elevator car from one elevator shaft to another elevator shaft it is checked whether the corresponding elevator car is empty. For this purpose sensors can be mounted in or at the elevator car. Only then is the shaft change initiated and carried out in the region of a changeover zone.

A further form of the present invention is distinguished by the fact that there are cross connections to intermediate floors which enable elevator cars to horizontally displace to another shaft even before reaching the upper or lower shaft end. Thus, elevator cars in the case of need can be displaced prematurely in order to return to the starting point without having to travel along the entire building height. This form of embodiment increases the flexibility in readying of elevator cars.

It is an advantage of the present invention that shaft changes can take place in the region of the changeover zones 12.1-12.3 or 15.1-15.2 while the elevator cars are loaded/unloaded in an adjacent boarding zone 17.1 or 17.2.

It is an advantage of the present invention that the handling capacity per building area occupied by the elevator installation can be increased by a factor of up to four relative to conventional elevator installations. Stated in other words, an elevator installation according to the present invention can be designed so that it occupies a shaft area which is approximately four times smaller. The increased number of individually movable elevator cars and the additional space requirement for the changeover zones is in that case not of such significance.

According to the present invention the handling capacity per elevator shaft is maximized and the reorganized shaft volume relative to the traffic performance is minimized.

It is a further advantage of the present invention that the requirements of the shaft change and thus the complexity of the changeover mechanism are smaller, since the changeover zones according to the present invention are used. It is also regarded as an advantage that the shaft change takes place less rapidly and therefore a lesser amount of disruptive noises and vibrations occurs.

According to the present invention there is provided an elevator installation and a method which enable good transport performances with a manageable constructional outlay. The present invention offers a high degree of flexibility, since in the case of need empty elevator cars can be provided at different points.

The more changeover zones that are provided, the more flexibly can the traffic concept of the elevator installation be designed, although on the other hand obviously the need for space increases.

The use of a changeover zone with a depot region has the advantage that only the currently required number of elevator cars has to be kept in circulation. This has, for example, an influence on the overall energy balance of an elevator installation. In addition, wear is reduced, since the elevator cars are not permanently in use.

The waiting times in front of elevator shafts and the occupation time in the elevator cars are, by virtue of the present invention, shorter. The constructional costs can be lowered by comparison with conventional approaches.

It is an advantage of the present invention that, in up-peak operation, elevator cars can be provided in the appropriate elevator shafts sufficiently quickly without a complicated and, in particular, quick-action changeover mechanism being needed. Thus, no special constructional/mechanical measures have to be undertaken in order to accelerate the horizontal movement of the elevator cars and the introduction of the elevator cars into the vertical elevator shafts, since due to the use of the changeover zones these processes are no longer the actual 'bottleneck'.

It is a further advantage of the present invention that even if a disturbance should occur in a changeover zone, the elevator operation can be maintained, since another changeover zone can be used for the horizontal shaft change.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of operating an elevator installation with vertical elevator shafts and with a plurality of individually movable elevator cars traveling in the shafts, wherein changeover zones are provided which enable displacement of the elevator cars between the elevator shafts, the elevator installation having at least three of the vertical elevator shafts arranged adjacent to one another and at least two of the changeover zones arranged directly adjacent to one another below or above a boarding zone, comprising the steps of:

a. moving selected ones of the elevator cars to a boarding zone in the elevator shafts for loading and transporting; and b. moving another one of the elevator cars from one of the changeover zones to the boarding zone after one of the elevator cars has left the boarding zone to travel in one of the elevator shafts while preventing loading and unloading of the elevator cars in the changeover zones whereby a procedure of loading and unloading the elevator cars is decoupled from a procedure of a shaft change of the elevator cars.

2. The method according to claim 1 including a step of horizontally displacing the elevator cars between two of the elevator shafts, wherein the displacement is carried out independently by one of the respective elevator car itself and a stationary changeover mechanism.

3. The method according to claim 1 including providing, depending on need, several empty ones of the elevator cars in the changeover zones so as to enable rapid moving up of the empty elevator cars in the case of a request call or as soon as another one of the elevator cars has left the region of the boarding zone.

4. The method according to claim 1 including providing a need profile and moving empty elevator cars to the changeover zones in the vicinity of the boarding zone according to the need profile.

5. The method according to claim 1 moving one of the elevator cars from one of the shafts to another of the shafts in one of the two changeover zones and depositing empty ones of the elevator cars in the other of the two changeover zones.

6. The method according to claim 1 including performing a readying sequence to move the elevator cars to different positions in the elevator installation in accordance with a default setting when no or only little transport need exists.

7. An elevator installation comprising:

at least three adjacent vertical elevator shafts sharing a boarding zone for loading and unloading passengers;

a plurality of elevator cars individually movable horizontally and vertically; and at least two adjacent changeover zones being arranged below or above said boarding zone enabling horizontal displacement of said elevator cars between said elevator shafts, and preventing loading and unloading of said elevator cars in the changeover zones whereby a procedure of loading and unloading said elevator cars is decoupled from a procedure of a shaft change of said elevator cars.

8. The elevator installation according to claim 7 wherein said boarding zone is in a lower region of a building, said changeover zones being arranged at a lower end of said shafts and below said boarding zone.

9. The elevator installation according to claim 7 wherein said boarding zone is in an upper region of a building, said changeover zones being arranged at an upper end of said shafts and above said boarding zone.

10. The elevator installation according to claim 7 wherein at least one of said changeover zones provides at least one of an access opening, a deposit region and a service region.

11. The elevator installation according to claim 7 including a further changeover zone independent of said at least two changeover zones arranged directly adjacent to said at least two changeover zones enabling displacement of said elevator cars between at least two of said elevator shafts.

12. The elevator installation according to claim 7 wherein one of said elevator shafts is a long-distance shaft for journeys of said elevators over several floors.

* * * * *